US007094135B2

(12) United States Patent
Chisum et al.

(10) Patent No.: US 7,094,135 B2
(45) Date of Patent: Aug. 22, 2006

(54) ABRASIVEJET CUTTING HEAD WITH BACK-FLOW PREVENTION VALVE

(75) Inventors: Dennis Chisum, Ephrata, WA (US); Stanley Swenson, Ephrata, WA (US)

(73) Assignee: International Waterjet Parts, Inc., Ephrata, WA (US)

( * ) Notice: Subject to any disclaimer, the term of this patent is extended or adjusted under 35 U.S.C. 154(b) by 94 days.

(21) Appl. No.: 10/914,902

(22) Filed: Aug. 10, 2004

(65) Prior Publication Data

US 2006/0035570 A1 Feb. 16, 2006

(51) Int. Cl.
*B24C 7/00* (2006.01)

(52) U.S. Cl. ..... 451/101; 239/339; 451/91

(58) Field of Classification Search ..... 451/90, 451/91, 101, 102; 239/339
See application file for complete search history.

(56) References Cited

U.S. PATENT DOCUMENTS 3,690,565 A * 9/1972 Abos ..... 239/447
4,060,341 A * 11/1977 Tremain et al. ..... 417/182.5
4,534,139 A * 8/1985 Desjardins ..... 451/101
4,541,780 A * 9/1985 Moreland ..... 4/541.6
4,650,470 A * 3/1987 Epstein ..... 604/149
5,421,767 A * 6/1995 Spears et al. ..... 451/101
5,643,058 A * 7/1997 Erichsen et al. ..... 451/99
5,810,045 A * 9/1998 Evans ..... 137/312
6,607,175 B1 * 8/2003 Nguyen et al. ..... 251/63.5

* cited by examiner

*Primary Examiner*—Timothy V. Eley
(74) *Attorney, Agent, or Firm*—Seldon & Scillieri

(57) ABSTRACT

An abrasivejet cutting head is disclosed that includes a valve assembly for preventing back-flow to the abrasive hopper of abrasive-laden fluid from the cutting head when the discharge path for the abrasivejet becomes clogged or otherwise blocked. The valve assembly is positioned within the abrasive line to conduct abrasive from the hopper towards the abrasivejet nozzle. The valve assembly further includes a discharge path which is sealed off from the abrasivejet nozzle during normal operation in response to the relatively lower pressure in the abrasive jet nozzle that results from the flowing fluid therein. If the jet path is blocked or competed in a manner that causes a backflow of the abrasive-laden slurry therein, the cessation of low pressure permits the backflowing slurry to exit via the discharge path and bypass the hopper, substantially avoiding the downtime previously required to clean the hopper.

6 Claims, 3 Drawing Sheets

ABRASIVEJET CUTTING HEAD WITH BACK-FLOW PREVENTION VALVE

TECHNICAL FIELD

This invention relates to abrasivejet systems.

BACKGROUND OF THE INVENTION

The use of high velocity, abrasive-laden liquid jets to precisely cut a variety of materials is well known. Briefly, a high velocity liquid jet is first formed by compressing the liquid to an operating pressure of 3,500 to 150,000 psi, and forcing the compressed liquid through an orifice having a diameter approximating that of a human hair; namely, 0.003–0.040 inches. The material defining the waterjet-forming orifice is typically a hard jewel such sapphire, ruby or diamond.

The resulting highly coherent jet is discharged from the orifice at a velocity which approaches or exceeds the speed of sound. The liquid most frequently used to from the jet is water, and the high velocity jet described hereinafter may accordingly be identified as a waterjet. Those skilled in the art will recognize, however, that numerous other liquids can be used without departing from the scope of the invention, and the recitation of the jet as comprising water should not be interpreted as a limitation.

To enhance the cutting power of the waterjet, abrasive materials have been added to the jet stream to produce an abrasive-laden waterjet, typically called an "abrasivejet". The abrasivejet is used to effectively cut a wide variety of materials from exceptionally hard materials (such as tool steel, aluminum, cast iron armor plate, certain ceramics and bullet-proof glass) to soft materials (such as lead). Typical abrasive materials include garnet, silica, and aluminum oxide having grit sizes of #36 through #200.

To produce the abrasivejet, the waterjet passes through a "mixing region" wherein a quantity of abrasive is entrained into the jet by the low pressure region that surrounds the flowing liquid in accordance with the Bernoulli Principle. The abrasive, which is under atmospheric pressure in an external hopper, is drawn into the mixing region by the lower pressure region via a conduit that communicates with the interior of the hopper. In operation, quantities of up to 6 lbs./min of abrasive material have been found to produce a suitable abrasive jet.

The resulting abrasive-laden waterjet is then discharged against a workpiece through an abrasivejet nozzle that is supported closely adjacent the workpiece. The spent abrasive-laden water is drained away from the workpiece in any of a number of known ways, and collected in a collection tank for recycling of the abrasive and/or proper disposal.

During operation of abrasivejet systems, the fluid path between the mixing region and the discharge opening of the abrasivejet nozzle can become clogged or blocked sufficiently to cause the abrasive-laden water to back up to and into the external hopper. The system must then be shut down so that the external hopper can be emptied of the resulting slurry, cleaned, dried and refilled with abrasive. In addition, the abrasive-carrying conduit must be cleaned and dried or replaced, and the orifice member and other internal components of the cutting head must be cleaned as well. The resulting downtime of the cutting system increases the cost of production, adversely affects production schedules and creates unexpected messy work for the operator.

BRIEF SUMMARY OF THE INVENTION

The invention herein comprises an abrasivejet cutting system and method employing a unidirectional valve assembly that directs abrasive-laden back-flow away from the hopper, and preferably to the collection tank. Further details concerning the invention will be appreciated from the following description of the preferred embodiment, of which the drawing is a part.

THE DRAWING

DETAILED DESCRIPTION OF THE INVENTION

Figure 1:
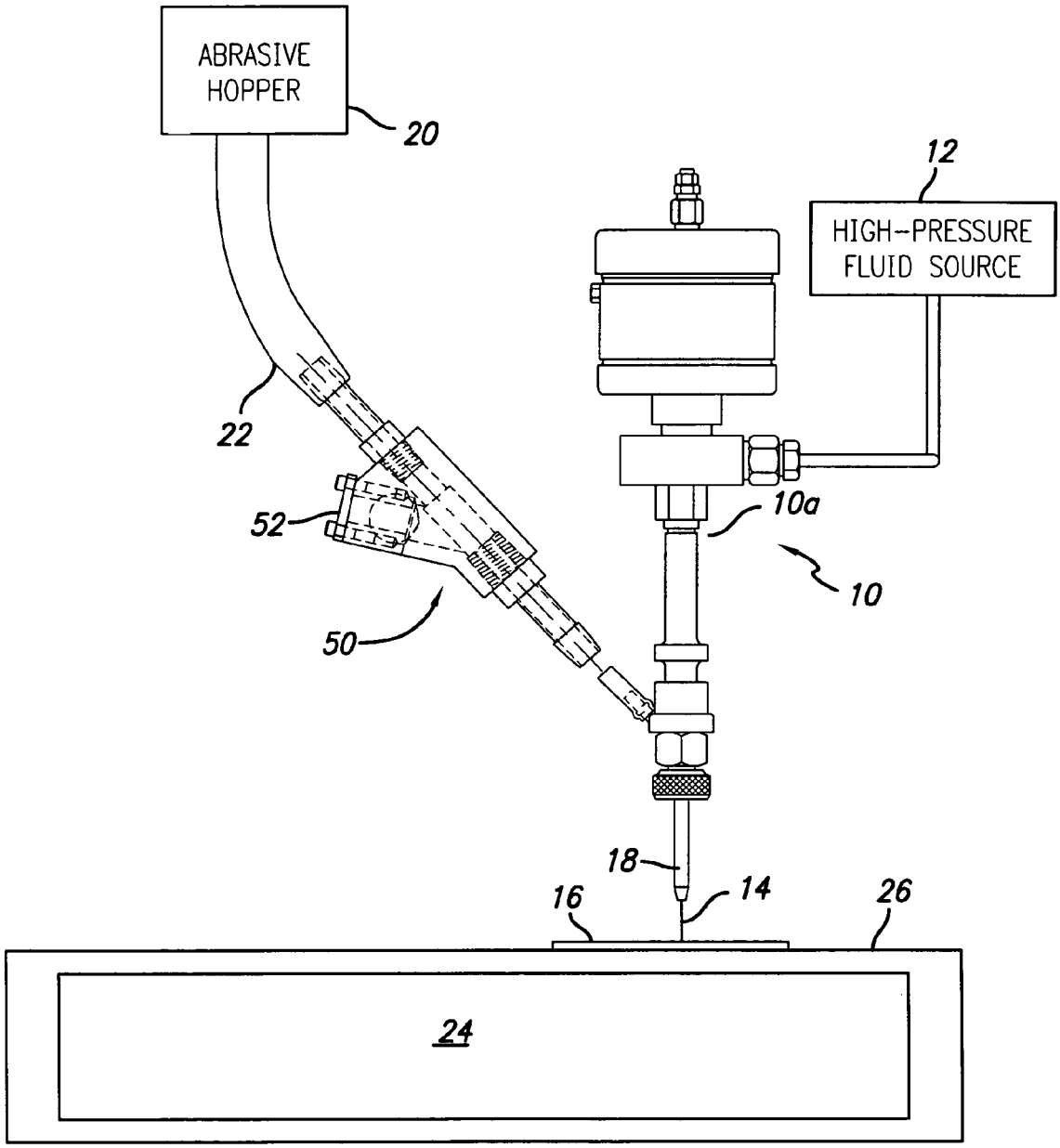
FIG. 1 is a schematic illustration of an abrasivejet cutting system with unidirectional valve constructed in accordance with the invention.

Referring now to the FIG. 1 wherein depicted elements are not necessarily shown to scale and wherein like or similar elements will be designated by the same reference numerals through the several views, FIG. 1 is a schematic illustration of an abrasivejet cutting system constructed in accordance with the invention. A cutting head 10 is coupled at its upstream end 10*a* to a source 12 of high pressure fluid such as water. As known by those skilled in the art, the cutting head includes an orifice member (not illustrated) in its upstream region that has a waterjet-forming orifice formed in a hard jewel material such as ruby, sapphire or the like. The highly pressurized fluid is forced through the orifice, resulting in the formation of a highly cohesive waterjet that can reach speeds in excess of the speed of sound.

To increase the cutting power of the waterjet, it is known in the art to entrain abrasive into the jet to form an abrasivejet. Abrasive, such as garnet or silica, is accordingly conducted from an abrasive hopper 20 to the cutting head 10 by a conduit 22. The abrasive enters the cutting head downstream of the orifice member in a region known in the art as the "mixing region". The abrasive enters the cutting head through a passageway in the cutting head, and becomes entrained with the waterjet by the relatively low pressure that surrounds the flowing waterjet in accordance with Bernoulli's Principle. This relatively low pressure pulls abrasive from the conduit as the waterjet flows through the mixing region, causing abrasive to flow from the hopper to the cutting head via the conduit.

The resulting abrasivejet 14 is discharged from an abrasivejet nozzle 18, and impacts a workpiece 16 that is supported over a collection tank 24 by a support structure 26. The support structure is configured to enable the spend abrasive-laden fluid to drain to the collection tank, typically by using a porous surface as the workpiece-supporting surface.

On occasion, the abrasivejet's discharge path becomes sufficiently blocked to cause a backflow of the abrasive-laden fluid that travels up the conduit 22 and into the hopper, creating a messy slurry in the conduit and the hopper that must be cleaned out before the cutting operation can continue. The backflow travels up the conduit because it is the path of least resistance; the cutting head region upstream of the mixing region is filled with high pressure fluid from the source 12, while the conduit and hopper are at substantially atmospheric pressure. The high pressure fluid thereby acts as a barrier to the backflowing abrasive-laden fluid, diverting it up the conduit.

In accordance with the invention, the abrasive-carrying conduit 22 is directed to the cutting head through a unidirectional valve assembly 50. The valve assembly 50 includes a discharge port 52 that through which backflowing fluid is diverted, preferably to the collection tank 24. The preferred valve assembly 50 is best shown in FIG. 2.

Figure 2:
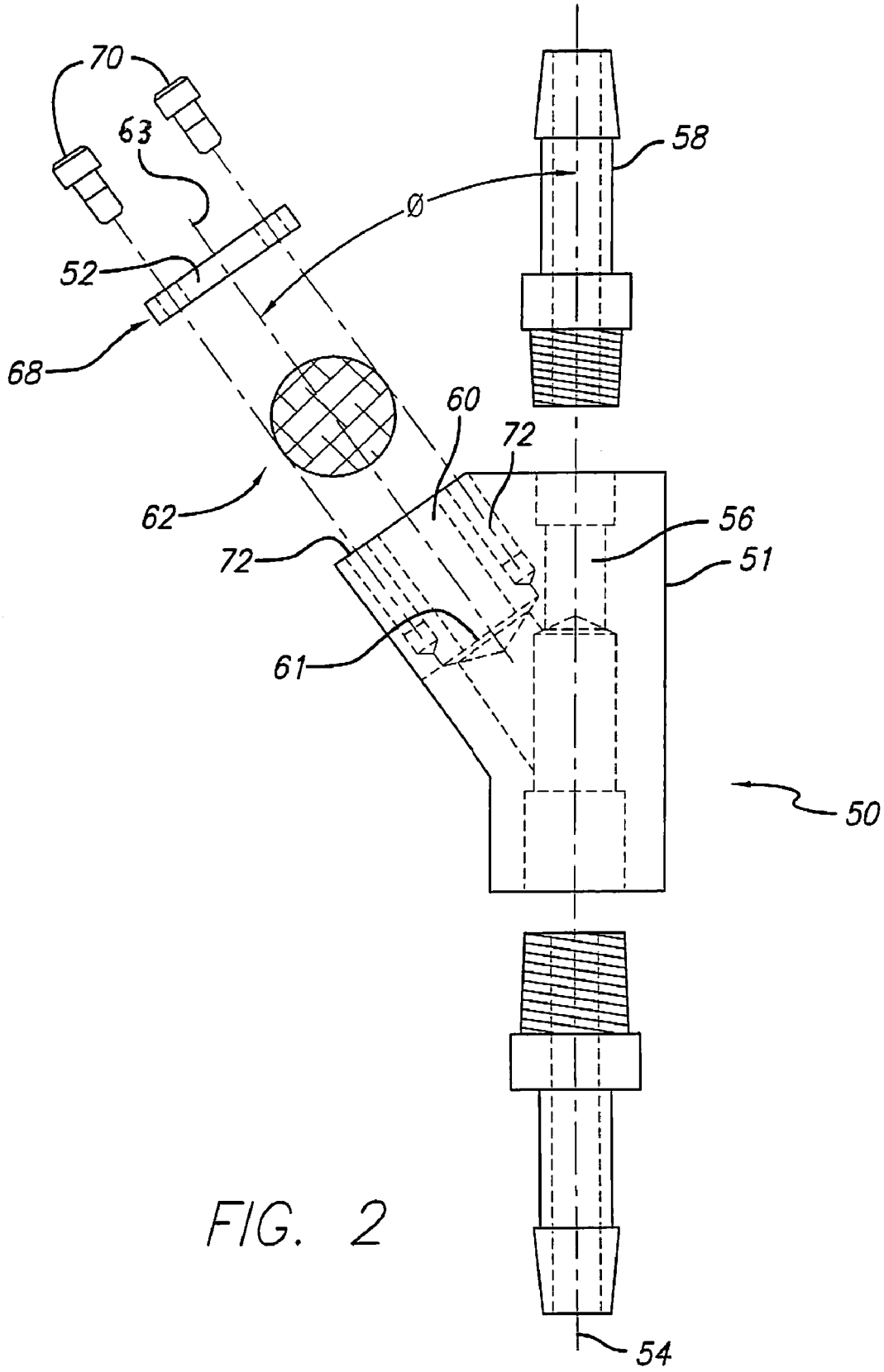
FIG. 2 is a perspective view in explosion of the valve assembly 50 of FIG. 1.

FIG. 2 is a perspective view in explosion of the valve assembly 50 of FIG. 1. The valve assembly 50 comprises an valve body 51 disposed about a longitudinal axis 54 and having a longitudinally-extending passageway 56 that passes through the body 51 from its upstream end to its downstream end. The body is preferably made of aluminum, but other materials such as stainless steel and other non-rusting metals could also be used. A generally tubular ⅛ NPT barb fitting 58 is threaded into the upstream end of the valve body to connect the upstream end of the passage 56 to an upstream portion of the abrasive conduit 22. A generally tubular ¼ NPT barb fitting is similarly threaded into the downstream end of the valve body to couple the downstream end of the passage 56 to a downstream end portion of the abrasive conduit 22 and, consequently, the cutting head's abrasive passage.

The valve body 51 additionally has a discharge passage 60 formed about a discharge axis 63 that extends obliquely towards the longitudinal axis from the upstream direction into the passage 56. preferably at an angle θ of 30–45°. The end region of the discharge passage 60 is in fluid commumcation with the passage 56 through a valve opening 61.

A check ball 62 is positioned within the discharge passage 56. The ball 62 is preferably made from a rubber-neoprene material of approximately ⅜"–⅝" diameter, and is larger in diameter than the valve opening 61. The ball 62 is retained in the discharge passage by a cap 68 having a central discharge port 52. The cap 68 is conveniently secured to the valve body 51 by screws 70 that are tightened into threaded holes 72 in the valve body.

Figure 3:
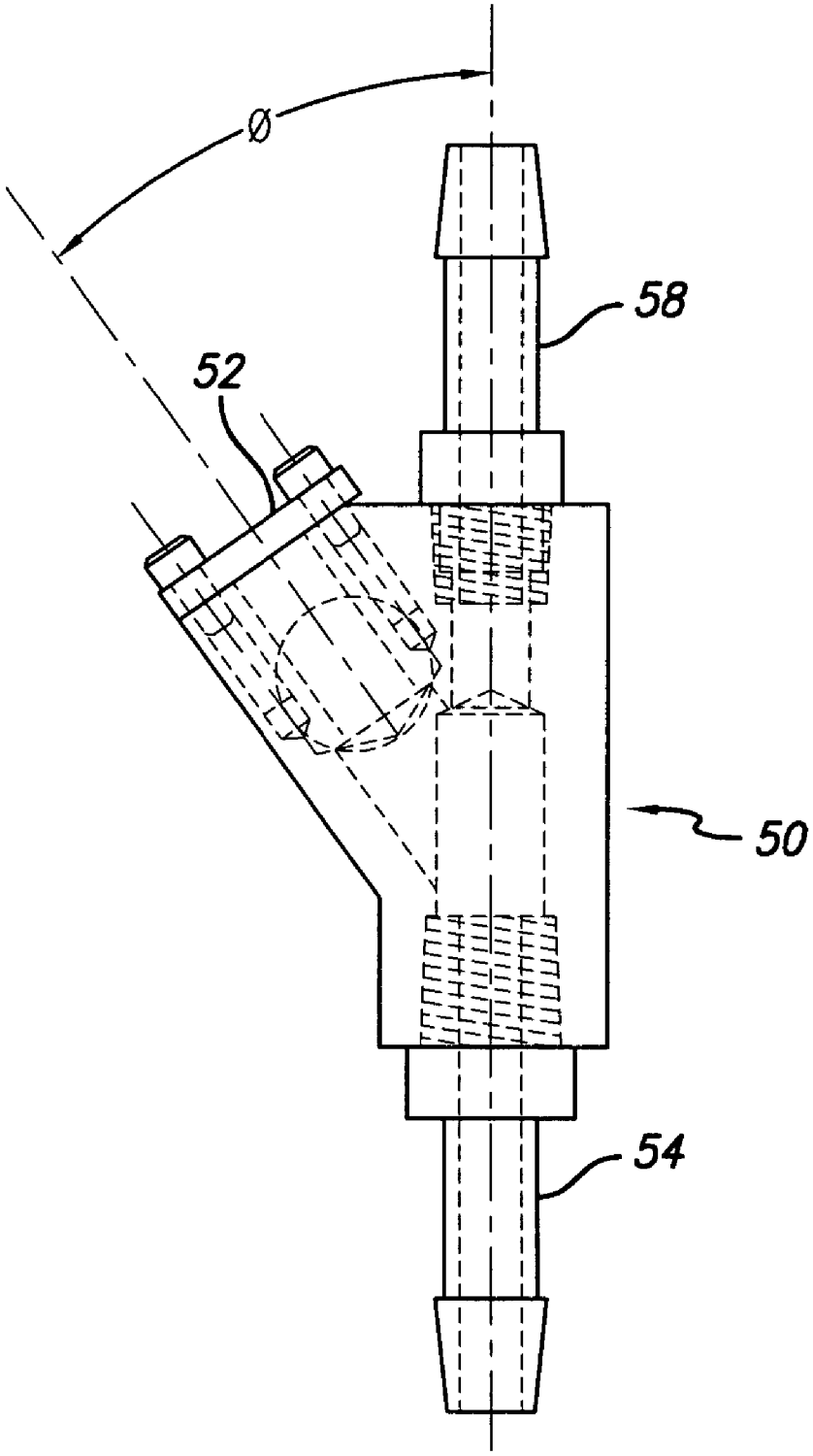
FIG. 3 is a perspective view of the valve assembly 50 of FIG. 1 during normal operation of the cutting system.

As illustrated in FIG. 3, the check ball 62 is pulled during normal system operation into firm sealing contact with the region circumscribing the valve opening 61 by the low pressure region in passageway 56, as conducted by conduit 22 (FIG. 1) from the region in the cutting head surrounding the fluidjet. Accordingly, as illustrated in FIG. 1, abrasive from the hopper 20 passes through fitting 58, passage 56 and fitting 54 into the mixing region of the cutting head for entrainment into the fluidjet. Neoprene was chosen for the ball's material for its relatively light weight and good sealing characteristics when contacting the region around the valve opening 61 owing, in part, to it's ability to "self-seat" against the region's surface. Naturally, other suitable materials can be used without exceeding the scope of the invention.

Should the abrasivejet's path become sufficiently blocked to create a backflow that pushes abrasive-laden fluid back towards the hopper, the sudden appearance of accumulated abrasive/fluid mixture at the discharge region of the cutting head will quickly cause a disruption of the fluidjet. The cessation of the fluidjet eliminates the low pressure region surrounding the fluidjet and, therefore, the low pressure in the passage 56. Consequently, the source of the sealing force acting on the ball 62 ceases, and the backflowing abrasive/fluid mixture is able to move the ball away from the valve opening 61 and discharge through the port 52. Because the valve body passage 56 upstream of its intersection with discharge passage 60, as well as the conduit 22 upstream of the valve body and the hopper 20 are all substantially filled with abrasive, the abrasive/fluid mixture takes the path of least resistance and discharges to atmosphere through the discharge port 52, thereby eliminating the backflow to the hopper and the consequential need to shut down the system in order to clean and refill the hopper and conduit.

Instead, the valve assembly can simply be detached from the fittings 54, 58, the screws 70 removed and the valve body flushed to remove any accumulated abrasive.

Although the present invention and its advantages have been described in detail, it should be understood that various changes, substitutions and alterations can be made herein without departing from the spirit and scope of the invention as defined by the appended claims.

We claim:

1. For use in an abrasivejet cutting system of the type including (a) a cutting head disposed about a first generally longitudinal axis and having an upstream end region, a downstream end region, and a longitudinally-extending fluid passageway in fluid communication with said end regions, said upstream region being adapted for coupling to a source of high pressure fluid, said downstream region being adapted to releasably secure an abrasivejet nozzle to hold said nozzle adjacent a workpiece, said cutting head including orifice-defining means positioned within the fluid passageway to receive high pressure fluid from the upstream end region and create a fluidjet flowing from said orifice towards the downstream end region in substantial co-axial alignment with said fluid passageway, said fluidjet inducing a generally co-extensive region of low pressure said cutting head additionally including abrasive passageway means for conducting abrasive into the fluid passageway downstream of the orifice-defining member to entrain said abrasive in the fluidjet; and (b) an abrasive hopper for holding a quantity of abrasive material to be conducted to the cutting head;

a valve assembly for preventing the backflow of fluid and abrasive from said cutting head to the hopper comprising:

a valve body disposed about a second generally longitudinal axis, said valve body having an upstream end, a downstream end and a generally longitudinally-extending abrasive passageway in fluid communication with its upstream and downstream ends;

first abrasive conduit means for conducting abrasive from the hopper into the upstream end of the abrasive passageway, second conduit means for conducting abrasive from the downstream end of said abrasive passageway into the abrasive passageway means of the cutting head, the valve body including a discharge passage formed about a discharge axis that extends obliquely to said second longitudinal axis from the upstream direction into the valve body's abrasive passageway, the valve body having a discharge port at the upstream end of the discharge passageway, a freely movable body member positioned within the discharge passage, said body member being of appropriate size, weight and material to be pulled by the low pressure created by the fluidjet into sealing engagement with the valve body to substantially seal the discharge passage from the valve body's abrasive passageway, and to attain a non-sealing position when contacted by backflowing abrasive and fluid moving from the downstream end of the valve body towards the upstream end of the valve body, whereby backflowing abrasive and fluid is conducted by the valve's discharge passageway to the discharge port for discharge from the valve body.

2. The valve assembly of claim 1 including cap means adjacent the discharge port for capturing the body member within the discharge passageway while permitting the egress of abrasive and fluid.

3. The valve member of claim 1 wherein the body member is generally spherical.

4. The valve member of claim 1 wherein the angle between the first and second longitudinal axes is between and including approximately 30° to 45°.

5. For use in the abrasive line of an abrasivejet cutting system having (a) an abrasivejet-forming cutting head coupled to a source of high pressure fluid for forming a waterjet having a surrounding low pressure region, (b) a hopper containing abrasive material and (c) an abrasive line including conduit means for conducting abrasive from a hopper to the cutting head for entrainment of the abrasive material into the waterjet for subsequent discharge against a workpiece, a valve assembly having a discharge port and positioned within the abrasive line, said valve assembly having (1) a first through-passageway for conducting abrasive traveling from the hopper to the cutting head, (2) a discharge passageway in fluid communication with the through-passageway and the discharge port for diverting to the discharge port abrasive and fluid backflowing from the cutting head into the through-passageway and (3) a linearly movable body member positioned in the discharge passageway to seal said discharge passageway from said through passageway in response to low pressure in the through passageway from the flowing waterjet, and responsive to the absence of said low pressure to assume a non-sealing position.

6. For use in the abrasive line of an abrasivejet cutting system having (a) an abrasivejet-forming cutting head coupled to a source of high pressure fluid for forming a waterjet having a surrounding low pressure region, (b) a hopper containing abrasive material and (c) an abrasive line including conduit means for conducting abrasive from a hopper to the cutting head for entrainment of the abrasive material into the waterjet for subsequent discharge against a workpiece, a valve assembly having a discharge port and positioned within the abrasive line, said valve assembly having (1) a first through-passageway for conducting abrasive traveling from the hopper to the cutting head, (2) a discharge passageway in fluid communication with the through-passageway and the discharge port for diverting to the discharge port abrasive and fluid backflowing from the cutting head into the through-passageway and (3) a linearly movable body member positioned in the discharge passageway to seal said discharge passageway from said through passageway in response to low pressure in the through passageway from the flowing waterjet, and responsive to the force of backflowing abrasive and fluid from the cutting head in the through passageway to assume a non-sealing position permitting said backflowing abrasive and fluid to flow to the discharge port through the discharge passage.

* * * * *